US005764258A

United States Patent [19]

Hetzer et al.

[11] Patent Number: 5,764,258

[45] Date of Patent: Jun. 9, 1998

[54] PRINT HEAD WITH INTEGRATED PUMP

[75] Inventors: Ulrich Hetzer; André-Heinrich Meinhof, both of Berlin, Germany

[73] Assignee: Eastman Kodak Company, Rochester, N.Y.

[21] Appl. No.: 510,211

[22] Filed: Aug. 2, 1995

[30] Foreign Application Priority Data

Aug. 20, 1994 [DE] Germany ..... 44 29 592.8

[51] Int. Cl.[6] ..... B41J 2/175; B41J 2/165

[52] U.S. Cl. ..... 347/85; 347/35

[58] Field of Search ..... 347/85, 1, 56, 347/63, 65, 35; 417/207, 322, 413.2

[56] References Cited

U.S. PATENT DOCUMENTS

| | | | |
|---|---|---|---|
| 4,376,945 | 3/1983 | Hara et al. | 347/63 |
| 4,609,925 | 9/1986 | Nozu et al. | 347/35 |
| 4,668,965 | 5/1987 | Tanaka et al. | 347/35 |
| 5,171,132 | 12/1992 | Miyazaki et al. | 417/322 |
| 5,259,737 | 11/1993 | Kamisuki et al. | 347/1 |

FOREIGN PATENT DOCUMENTS

| | | | |
|---|---|---|---|
| 0 572 231 | 12/1993 | European Pat. Off. | B41J 2/14 |
| 58-96564 | 6/1983 | Japan | 347/35 |

*Primary Examiner*—Benjamin R. Fuller
*Assistant Examiner*—Judy Nguyen
*Attorney, Agent, or Firm*—Milton S. Sales

[57] ABSTRACT

A print head consists of an ink chamber with heater elements and orifices. Connected to the ink chamber is a pump chamber which is supplied with ink through an ink supply opening. The ink chamber and the pump chamber are enclosed between a first and a second end plate. The pump element is integrated within the pump chamber which forms part of the print head and there are divider elements and valve elements arranged lengthways along both sides of the pump element.

10 Claims, 2 Drawing Sheets

PRINT HEAD WITH INTEGRATED PUMP

BACKGROUND OF THE INVENTION

1. Technical Field

The invention relates to ink jet printing; and more particularly to a print head consisting of an ink chamber which contains heater elements and is connected to at least one orifice, and a pump chamber which is supplied with ink from an ink supply opening, the ink chamber and the pump chamber being enclosed between a first and a second end plate.

2. Background Art

Publication EP-A-0 572 231 discloses a print head of compact design which consists of an orifice section and a pump section. The pump section is attached to the orifice section. A piezo-electric component is located on the outer wall of the ink chamber (pump section). Actuation of the piezo-electric element deforms the outer wall and thereby the pump chamber. This alters the pressure within the ink chamber. If the pressure increases, ink is forced through the orifices without the heater elements having to be switched on to perform cartridge cleaning. Since the piezo-electric component is attached to the outer wall of the ink chamber, changes in pressure can only be brought about by deformation of the outer wall. The amount of energy expended in order to perform the deformation operation is undoubtedly high since the end plate being deformed displays a certain degree of rigidity, and therefore resists deformation.

DISCLOSURE OF THE INVENTION

The object of the present invention is to create a print head in which the amount of energy required to operate the pump is significantly reduced. Such purge pump construction, in accord with the invention. It will thereby ensure that the air expulsion and cleaning functions of a print head, and particularly of a print head of bubble-jet design, are correctly performed. An important aspect of activating a print head for the first time is simple and efficient expulsion of any air which might be inside it since the pumping effect of the heater elements and the capillary effect of the orifices can generally only be relied upon to operate correctly as long as the print head is full of ink.

Another object of the present invention is to create a print head which ensures that there is always sufficient ink in its ink chamber at the same time as remaining simple and economical to produce and compact in design.

The present invention achieves this by integrating the pump element within the pump chamber inside the print head and by the arrangement of dividers and valves lengthways along both sides of the pump element.

The advantages of the present invention are that a print head with an integrated pump can draw ink as required from an ink reservoir in an energy-efficient manner. In addition, particles of dirt and dried ink in the area of the orifice can be removed by means of a cleaning step performed by the micropump.

The pump elements can also be manufactured in the form of microstructures using the production methods familiar to the semiconductor industry such as bonding, galvanic coating, lithographic processes, isotropic and anisotropic etching.

Details of other embodiments of the invention are given in the dependent claims.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
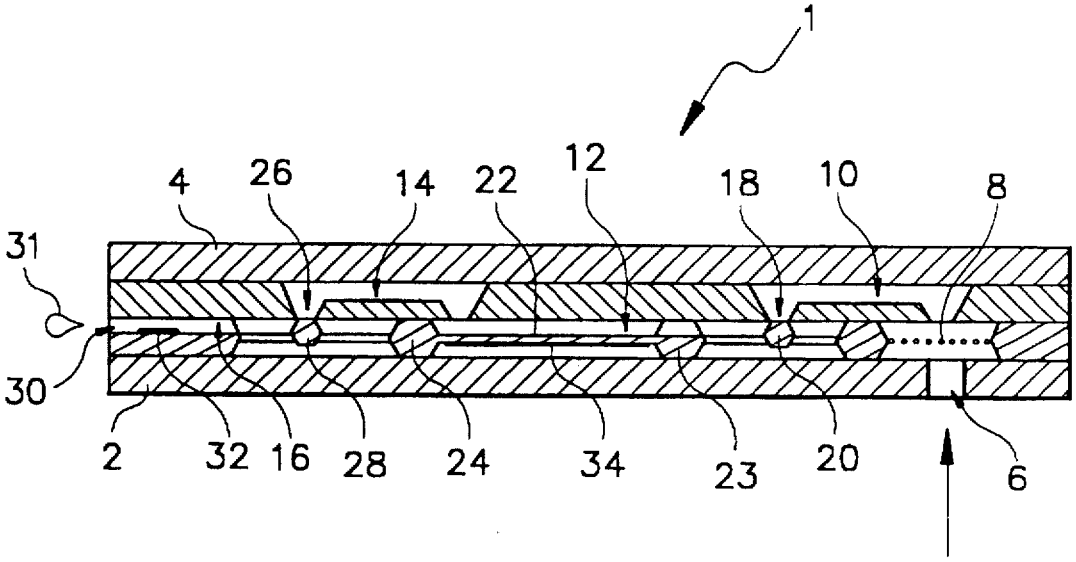
FIG. 1 is a cross section of a print head with a thermally activated micropump, in this case the diagram shows a print head which operates with an edge orifice.
Figure 2:
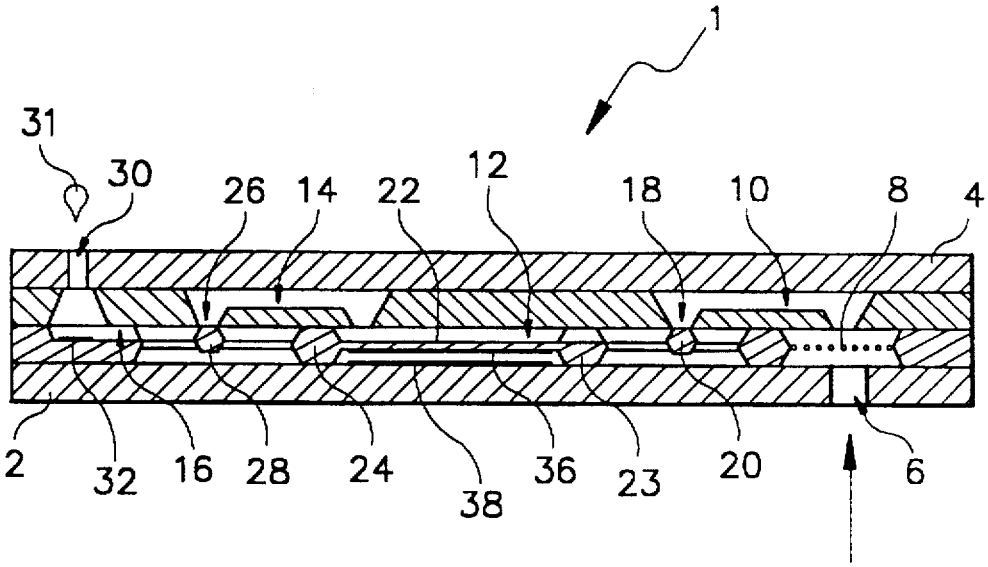
FIG. 2 is a cross section of a print head with an electrostatically activated micropump, in this case the diagram shows a print head which operates with a side orifice.

FIG. 1 and FIG. 2 show cross-sectional views of print heads 1 in accordance with the invention. The print head 1 consists of a first end plate 2 having an ink supply opening 6 through which ink is supplied to the print head 1 from an ink container (not shown). The incoming ink passes through a mesh structure 8 which is located upstream of the ink supply opening 6. The mesh structure acts as a filter for the ink coming from the ink container. The ink passes through a first channel 10 to the pump chamber 12 and via a second channel 14 to the ink ejection chamber 16. The outlet 18 of the first channel 10 can be closed by a first valve 20. The pump chamber 12 of the integral micropump in the print head 1 is formed by the first valve 20, the pump diaphragm 22 and dividers 23 and 24 and is connected to the ink ejection chamber 16 by a second channel 14. The pump chamber 12 connects through to the ink chamber 16. The outlet 26 of the second channel 14 can also be closed by a valve 28. The ink ejection chamber 16 of the print head is connected to at least one orifice 30 for ejection of ink droplets 31. Inside the ink ejection chamber 16 there is at least one heater element 32 which is used to create vapor bubbles which initiate ink ejection. The complete print head structure comprising ink ejection chamber 16, pump chamber 12, mesh structure 8 and channels 10, 14 is closed off by a second end plate 4.

The micropump integrated in the print head 1 shown in FIG. 1 is thermally activated. To this end there is a bi-metallic strip 34 attached to the pump diaphragm 22. The differing heat expansion coefficients of the two metals in the bi-metallic strip cause the pump diaphragm 22 to deform. A change in the temperature of the bi-metallic strip can be brought about, for example, by a thermo-electric component suitably connected to an electrical circuit (not illustrated).

The micropump integrated in the print head 1 shown in FIG. 2 is electrostatically activated. To this end there is a first electrode 36 attached to the side of the pump diaphragm 22 facing away from the pump chamber 12. Opposite the first electrode on the first end plate 2 is a second or opposing electrode 38. The pump diaphragm can be actuated by means of electrostatic attraction or repulsion. The differing electrical potentials of the first and second electrodes 36, 38 can be brought about by connection to a suitable electronic circuit (not illustrated).

As illustrated by FIGS. 1 and 2, the print head can operate with edge or side orifices. The method of operation of the pump is not dependent on the method of operation of the print head.

Figure 3A:
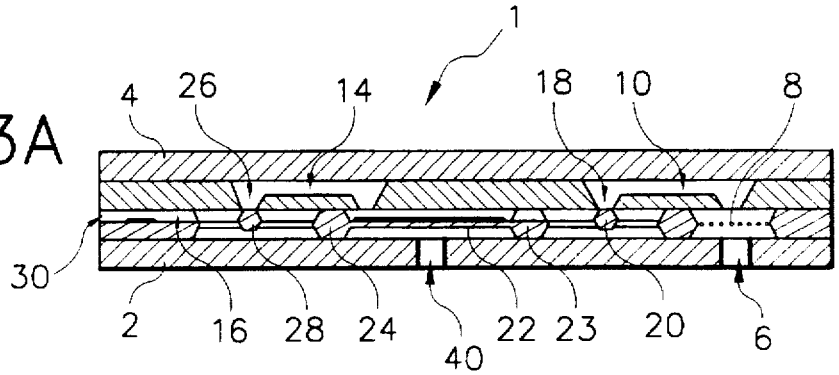
FIGS. 3A–3E are the method of operation of a print head with integrated micropump.

The method of operation of a print head 1 with integrated micropump is illustrated by FIGS. 3A–3E. The description which follows applies to a print head with integrated thermally activated diaphragm pump. It is self evident that the method of operation will be similar with other types of pump. FIG. 3A shows the print head with the integrated micropump in its neutral position. In addition to the ink supply orifice 6, the first end plate 2 also has a pressure equalization orifice 40 the purpose of which is to balance out the pressure fluctuations in the space between the first end plate 2 and the underside of the diaphragm caused by the movement of the diaphragm. The pressure equalization orifice 40 is situated directly opposite the pump diaphragm 22.

Figure 3B:
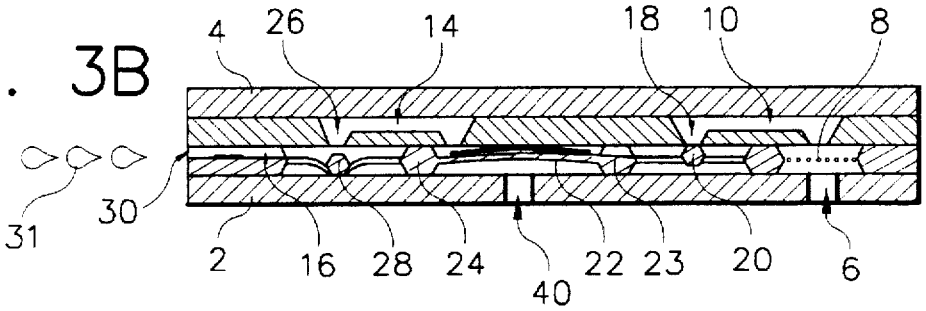

FIG. 3B shows the pump diaphragm when activated. The higher pressure in the pump chamber 12 opens the second valve 28 at the outlet 26 from the second channel 14. The pressure is transferred to the ink chamber 16 and ink is ejected from the orifice 30.

Figure 3C:
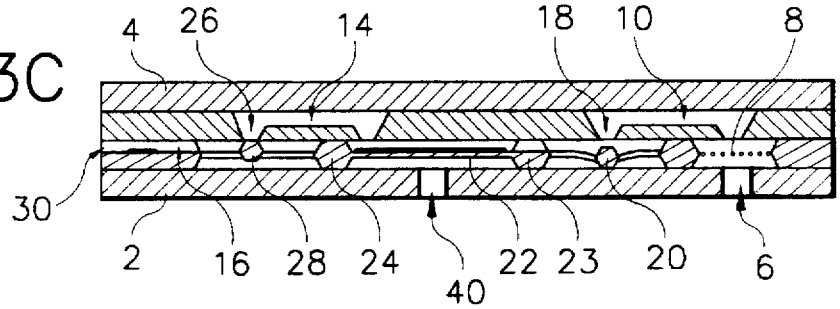

The pump diaphragm 22 is then de-activated and, due to its elasticity, returns to its original position as shown in FIG. 3C. This causes the pressure in the pump chamber to drop so that it is lower than the pressure in the first channel, with the result that the first valve 20 at the outlet 18 from the first channel opens and ink is drawn in from the ink container (not shown) through the ink supply opening 6.

Figure 3D:
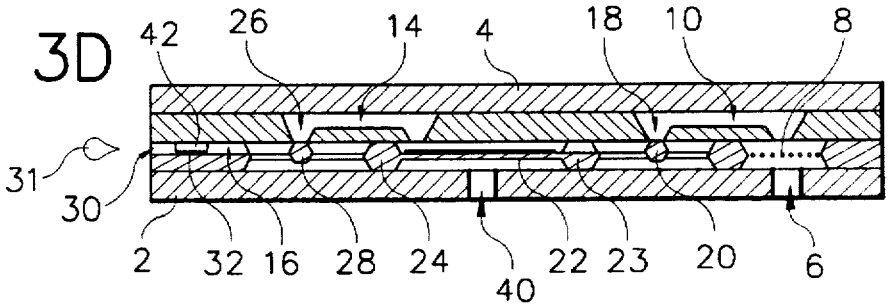

FIG. 3D illustrates the use of the heater element 32 to create a vapor bubble 42 which causes an ink droplet to be forced out of the orifice. The electric current flowing through the heater element 32 generates localized heat which causes the ink in contact with the heater element 32 to vaporize. The vapor bubble 42 which results increases the pressure in the ink chamber thus causing the valves 20, 28 to close.

Figure 3E:
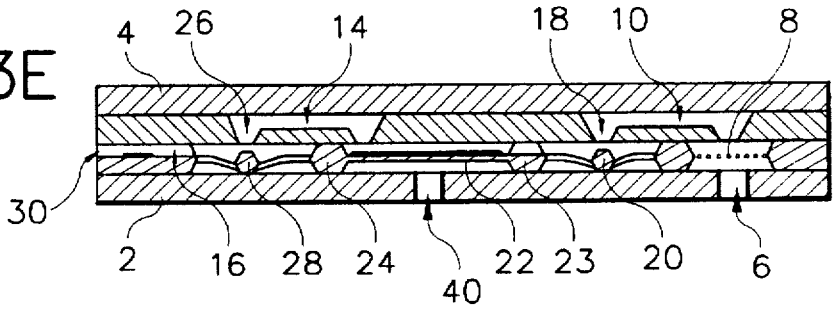

The effect of the cooling of the heater element, as illustrated in FIG. 3E, is to reduce the pressure in the ink chamber 16. This causes the valves 20, 28 to open with the result that the capillary effect of the ink jet draws in more ink thus refilling the ink ejection chamber 16.

The invention has been described in detail with particular reference to preferred embodiments thereof, but it will be understood that variations and modifications can be effected within the spirit and scope of the invention.

We claim:

1. An apparatus comprising:

(a) an ink jet print head having: (i) wall means for forming an elongated chamber including an ink supply region and an ink ejection region, (ii) a drop ejection actuator located in said ink ejection region, and (iii) a drop ejection orifice coupled to said ink ejection region;

(b) purge pump means, constructed within said chamber, for selectively providing positive pressure to fluid within said chamber; and (c) valve means, responsive to said positive pressure by said pump means, for controlling fluid flow within said chamber to effect purging of fluid through said drop ejection orifice.

2. The apparatus defined in claim 1 wherein said purge pump means is located between said ink supply region and said ink ejection region.

3. The apparatus defined in claim 2 wherein said purge pump means comprises a diaphragm member movable within said chamber.

4. The apparatus defined in claim 3 further comprising means responsive to thermal energy for moving said diaphragm member to provide said positive pressure.

5. The apparatus defined in claim 4 wherein said means responsive to thermal energy comprises a bi-metallic strip coupled to said diaphragm.

6. The apparatus defined in claim 3 further comprising means responsive to electrostatic attraction for moving said diaphragm member to provide said positive pressure.

7. The apparatus defined in claim 6 wherein said means responsive to electrostatic attraction comprises a first electrode coupled to said diaphragm and further comprising a second electrode opposing said first electrode.

8. The apparatus defined in claim 2 wherein said valve means comprise a first valve member located between said purge pump means and said ink ejection region and a second valve member located between said purge pump means and said ink supply region.

9. The apparatus defined in claim 2 further comprising an ink inlet in communication with said ink supply region.

10. The apparatus defined in claim 9 further comprising a pressure equalization orifice proximate said pump means.

* * * * *